US005123053A

United States Patent [19]

House

[11] Patent Number: 5,123,053

[45] Date of Patent: Jun. 16, 1992

[54] LOUDSPEAKER SUSPENSION

[75] Inventor: William N. House, Bloomington, Ind.

[73] Assignee: Harman International Industries, Incorporated, Northridge, Calif.

[21] Appl. No.: 551,201

[22] Filed: Jul. 11, 1990

[51] Int. Cl.[5] ..... H04R 25/00; H04R 7/00

[52] U.S. Cl. ..... 381/188; 381/193; 381/202; 381/203; 181/171; 181/157

[58] Field of Search ..... 381/193, 188, 202, 203, 381/204, 194, 190, 197; 181/171, 179, 159, 161

[56] References Cited

U.S. PATENT DOCUMENTS

| | | | |
|---|---|---|---|
| 1,585,333 | 5/1926 | Massalle et al. | 381/193 |
| 1,827,283 | 10/1931 | Forest | 181/163 |
| 1,913,645 | 6/1933 | Stenger | 381/202 |
| 1,939,922 | 12/1933 | Rockwell | 381/204 |
| 1,974,770 | 9/1934 | Engholm | 381/202 |
| 2,002,189 | 5/1935 | Round et al. | 181/171 |
| 3,201,529 | 8/1965 | Surh | 381/199 |
| 3,711,659 | 1/1973 | Bremseth | 381/194 |
| 3,919,498 | 11/1975 | Beer | 381/196 |
| 4,239,943 | 12/1980 | Czerwinski | 381/204 |
| 4,387,275 | 6/1983 | Shimada . | |
| 4,430,529 | 2/1984 | Nakagawa et al. | 381/190 |
| 4,817,165 | 3/1989 | Amalaha | 381/202 |
| 4,821,330 | 4/1989 | Pfleiderer | 381/184 |

FOREIGN PATENT DOCUMENTS

| | | | |
|---|---|---|---|
| 0844211 | 7/1939 | France | 381/193 |
| 0886492 | 1/1962 | United Kingdom | 381/202 |

OTHER PUBLICATIONS

PCT/US88/00685—Oct. 20, 1988—House.
PCT/US89/02374—Apr. 19, 1990—House.

*Primary Examiner*—James L. Dwyer
*Assistant Examiner*—Jason Chan
*Attorney, Agent, or Firm*—Barnes & Thornburg

[57] ABSTRACT

A transducer comprises a diaphragm including a perimeter, a motor for causing the diaphragm to vibrate in response to an electrical signal corresponding to program material to convert the electrical signal to motion of the diaphragm and thus to an audio reproduction of the electrical program material signal, and a surround and a frame for supporting the diaphragm from its perimeter to permit such motion. Additional diaphragm supports are provided on the frame and project from the frame toward the diaphragm. Additional compliances are provided on the diaphragm and are coupled to the additional diaphragm supports. The additional compliances are located adjacent the additional diaphragm supports.

3 Claims, 2 Drawing Sheets

LOUDSPEAKER SUSPENSION

BACKGROUND OF THE INVENTION

1. Field of the Invention

This invention relates to transducers and particularly to a mechanism for supporting the diaphragm of a diaphragm type, electrodynamic acoustical transducer from the supporting frame thereof.

2. Description of the Related Art

Various types of systems for supporting the diaphragms of diaphragm-type acoustical transducers from the frames of such transducers are known. The systems described in the following listed U.S. and foreign Patents are intended as illustrative of these various types of systems:

| Patent Number | Inventor's Name | Issue Date |
|---|---|---|
| 4,817,165 | Amalaha | 03/28/89 |
| 4,387,275 | Shimada | 06/07/83 |
| 4,821,330 | Pfleiderer | 04/11/89 |
| 3,919,498 | Beer | 11/11/75 |
| 2,478,642 | Root | 08/09/49 |
| 3,780,232 | Ward | 12/18/73 |
| 3,614,335 | Tester | 10/19/71 |
| 4,554,414 | House | 11/19/85 |
| 3,718,779 | Schoengold | 05/27/73 |
| 3,531,602 | Brown | 09/29/70 |
| 3,711,659 | Bremseth | 01/16/73 |
| 4,317,965 | Toyoda | 03/02/82 |
| 3,596,733 | Bertagni | 08/03/71 |
| 3,073,411 | Bleazey | 01/15/63 |
| **2,074,419A | Kakiuchi | 10/28/81 |

**British Patent Specification

This listing is not intended as a representation that a thorough search of all relevant prior art has been conducted, or that no closer prior art exists.

Of these patents, Amalaha, U.S. Pat. No. 4,817,165, Shimada, U.S. Pat. No. 4,387,275 and Pfleiderer, U.S. Pat. No. 4,821,330 appear to be the most pertinent. FIGS. 1 and 12C-13C of Amalaha disclose a bellows-type suspension positioned midway between the voice coil form and the dome surround. FIGS. 8, 9, 11 and 13 of Shimada disclose compliances other than the surround between the diaphragm and frame. However, these figures also disclose spiders between the voice coil form and the frame. FIG. 6 of Pfleiderer discloses vibration damping elements (SD) attached to the diaphragm between the voice coil form (P) and the surround (F). However, this appears to be a force diagram only, and does not reflect the actual physical structures of the Pfleiderer transducers.

SUMMARY OF THE INVENTION

According to the present invention, the prior art requirement for the spider is overcome. This permits the design of thinner acoustic transducers, in terms of transducer depth, for those installations for which the need for thinner transducers is most desirable, such as, for example, automotive vehicle door-mount installations.

According to the invention, a transducer comprises a diaphragm including a perimeter, means for causing the diaphragm to vibrate in response to an electrical signal corresponding to program material to convert the electrical signal to motion of the diaphragm and thus to an audio reproduction of the electrical program material signal, and means for supporting the diaphragm to permit such motion. The diaphragm supporting means includes a frame, a compliance for coupling the diaphragm perimeter to the frame to support the diaphragm while permitting such motion, and additional diaphragm support means on the frame and projecting from the frame toward the diaphragm. Additional compliance means are located adjacent the additional diaphragm support means and are coupled to the diaphragm and to the additional diaphragm support means.

Illustratively, there are a plurality of such additional diaphragm support means and an equal plurality of such additional compliance means. The additional diaphragm support means and additional compliance means are provided at a plurality of locations about the frame and diaphragm, respectively.

Additionally, illustratively, the perimeter of the diaphragm is configured generally as a closed plane curve and the plurality of additional compliance means are located generally symmetrically about the diaphragm with respect to the perimeter. In one embodiment, the perimeter of the diaphragm is configured generally as a closed plane curve having a center and the additional compliance means is located at substantially the center.

Further, illustratively, the diaphragm has two opposed radiating surfaces and the additional diaphragm support means are provided in pairs, one of each pair of additional diaphragm support means extending generally toward opposite locations on the two opposed radiating surfaces of the diaphragm.

In one illustrative embodiment, the diaphragm is generally flat. In another, the diaphragm generally comprises a somewhat conically shaped surface providing an apex.

BRIEF DESCRIPTION OF THE DRAWINGS

The invention may best be understood by referring to the following description and accompanying drawings which illustrate the invention. In the drawings.

DETAILED DESCRIPTIONS OF ILLUSTRATIVE EMBODIMENTS

Figure 1:
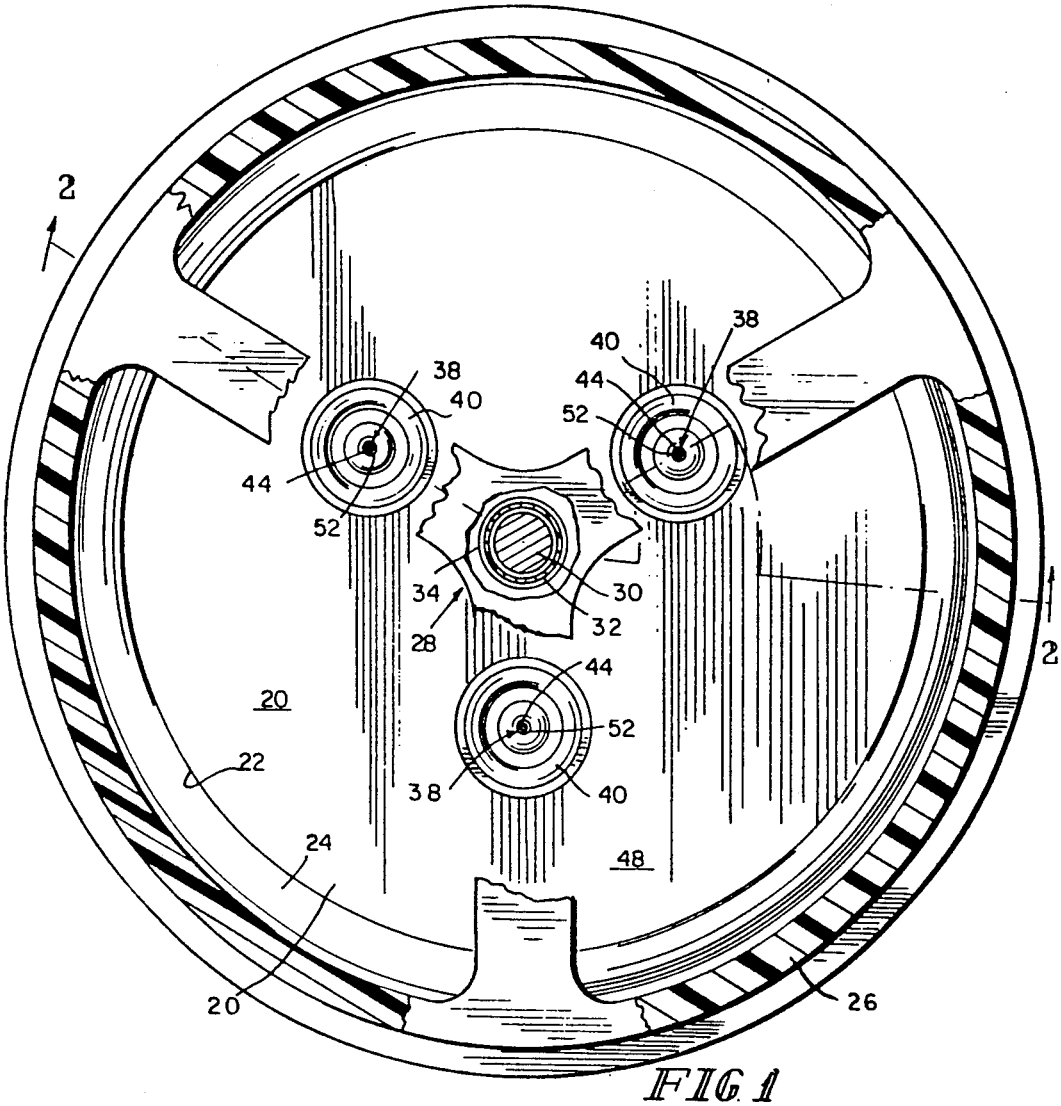
FIG. 1 illustrates a partly sectional plan view of a transducer constructed according to the invention, with the section taken generally along section lines 1—1 of FIG. 2.
Figure 2:
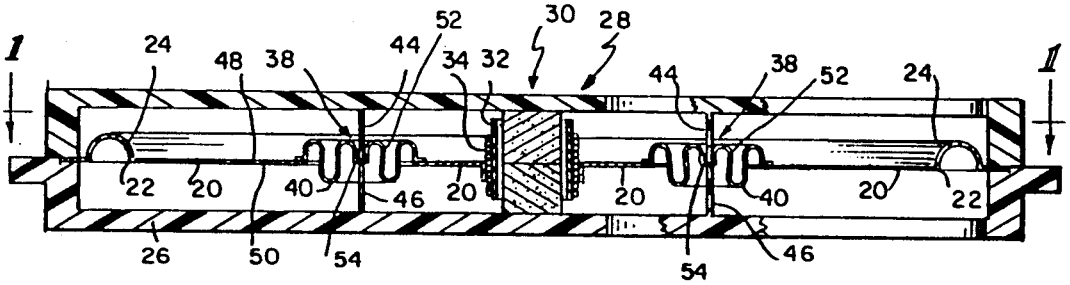
FIG. 2 illustrates a partly sectional elevational view of the transducer of FIG. 1, with the section taken generally along section lines 2—2 of FIG. 1; and, FIG. 3 illustrates a fragmentary and partly sectional elevational view of another transducer constructed according to the invention.

In a first embodiment of the acoustical transducer of the invention illustrated in FIGS. 1-2, a relatively rigid, flat diaphragm 20 constructed from, for example, a light-weight, foamed resin, is suspended from its perimeter 22 by a surrounding compliance 24 from a frame 26. Although the illustrated diaphragm 20 is circular in plan view, it is to be understood that it is not necessary to practice the present invention that the diphragm be circular. A voice coil motor 28 is positioned within the perimeter 22 of the diaphragm 20, illustratively at its center 30. The voice coil motor 28 includes a voice coil former 32 to which a voice coil 34 is fixed. Although the illustrated voice coil motor 28 is a so-called "returnless" type, such as is illustrated in U.S. Pat. Nos. 3,201,529 and, 4,868,882, voice coil motor 28 may be of any suitable type, such as that illustrated in published Patent Cooperation Treaty application PCT/US89/04501. Passage of current through the voice coil 34 moves the diaphragm 20, in accordance with well-known principles, to convert an electrical signal containing program material into an audio program material signal.

Although the diaphragm 20 is relatively rigid, it is useful to suspend it from one or more points 38 in addition to the surrounding compliance 24. In prior art diaphragms, this additional suspension is ordinarily achieved with a centering spider which extends between the voice coil former and one or more points on the frame. However, use of a centering spider attached to the voice coil former does require that the transducer be designed and constructed with sufficient depth to accommodate the "stack" including the diaphragm and centering spider. While alternative constructions have been proposed to minimize the height of this stack (see, for example, published Patent Cooperation Treaty application PCT/US88/00685), the present invention approaches more closely the ideal reduction in transducer depth by eliminating the spider. To achieve this, additional compliances 40 are provided on diaphragm 20. In the illustrated embodiment there are three such additional compliances 40 oriented at 120° intervals around the center 42 of the circle defined by the diaphragm 20. Each of the additional compliances 40 illustratively is also circular and is provided in the diaphragm 20 by known transducer construction techniques. Supports 44, 46, respectively, extend toward the opposite radiating surfaces 48, 50, respectively, of the diaphragm 20 from the frame 26. These supports 44, 46 are attached, for example, by suitable adhesives, to the oppositely facing surfaces 52, 54, respectively, of the compliances 40 to provide additional support to the diaphragm 20 beyond that provided by the surrounding compliance 24.

Figure 3:
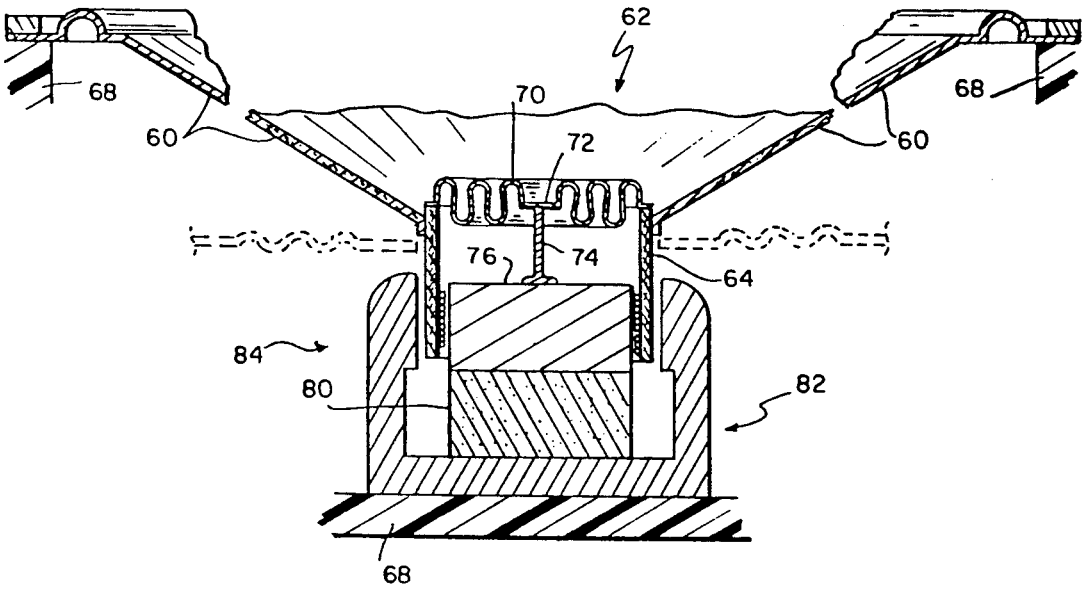

In another embodiment of the invention illustrated in FIG. 3, the diaphragm 60 is somewhat cone shaped. As used herein, the term "somewhat cone shaped" is intended to include diphragms which are neither flat nor dome shaped, whether or not they are symmetrical about any point or any axis. The term specifically is intended to include those diaphragms which are configured as described in published Patent Cooperation Treaty Application PCT/US89/02374. The configuration of the transducer 62 is generally conventional in this embodiment except that there is no centering spider in the conventional location between the voice coil former 64 and the frame 68 (as indicated by the broken lines), and the conventional, customarily flat or dome shaped dust cap is replaced by a compliance 70. The center portion 72 of the compliance 70 is attached, illustratively by a suitable adhesive, to a support 74 which is mounted to, and extends forward from the front face 76 of, the center pole piece 80 of the magnet assembly 82 of the voice coil motor 84.

What is claimed is;

1. A transducer comprising a diaphragm including a perimeter, means for causing the diaphragm to vibrate in response to an electrical signal corresponding to program material to convert the electrical signal to motion of the diaphragm and thus to an audio reproduction of the electrical program material signal, and means for supporting the diaphragm to permit said motion, the diaphragm supporting means including a frame, a compliance for coupling the diaphragm perimeter to the frame to support the diaphragm while permitting said motion, a plurality of additional diaphragm support means on the frame and projecting from the frame toward the diaphragm, and a plurality of additional compliance means coupled to the diaphragm and to respective ones of said additional diaphragm support means, said plurality of additional compliance means located adjacent said respective additional diaphragm support means, each additional compliance means having two opposed surfaces and said additional diaphragm support means being provided in pairs, the members of each pair of said additional diaphragm support means extending from the frame toward opposite locations on two opposed radiating surfaces of each respective additional compliance means.

2. The transducer of claim 1 wherein the perimeter of the diaphragm is configured generally as a closed plane curve and said plurality of additional compliance means are located generally symmetrically about the diaphragm with respect to the perimeter.

3. The transducer of claim 1 wherein the diaphragm is generally flat.

* * * * *